US005583556A

United States Patent [19]

Kim

[11] Patent Number: 5,583,556

[45] Date of Patent: Dec. 10, 1996

[54] PLATEN-TYPE PRINTER HAVING A DRUM WITH SHOULDERS

[75] Inventor: Jong-woo Kim, Suwon, Rep. of Korea

[73] Assignee: Samsung Electronics Co., Ltd., Kyungki-Do, Rep. of Korea

[21] Appl. No.: 314,779

[22] Filed: Sep. 29, 1994

[30] Foreign Application Priority Data

Sep. 29, 1993 [KR] Rep. of Korea ..... 93-20553

[51] Int. Cl.[6] ..... B41J 11/057; B41J 13/10; B41J 13/18

[52] U.S. Cl. ..... 347/218; 346/138

[58] Field of Search ..... 346/134, 138, 346/76 L, 108; 400/659, 662; 347/215, 218

[56] References Cited

U.S. PATENT DOCUMENTS 4,847,633 7/1989 Piatt et al. ..... 346/134

5,166,705 11/1992 Roh ..... 346/138

*Primary Examiner*—Huan H. Tran

*Attorney, Agent, or Firm*—Sughrue, Mion, Zinn, Macpeak & Seas

[57] ABSTRACT

A printer includes a drum rotated to transport a paper sheet together with and at the periphery of the drum, at least one guide roller disposed at the periphery of the drum and rotated while in contact with the drum to guide the paper sheet against the drum, and a printing device for printing image data on the paper sheet. A shoulder is formed at each side of the drum for guiding the sides of the paper sheet so that the paper sheet is transported between the shoulders. In the above printer, it is possible to print an image on the paper sheet without causing any margins in the upper and lower portions of the paper sheet and without any skewing of the image on the paper sheet, thereby preventing wasted paper. Also, the paper sheet can be brought into contact with the drum with a simple structure, thereby reducing the manufacturing cost of the printer.

5 Claims, 6 Drawing Sheets

PLATEN-TYPE PRINTER HAVING A DRUM WITH SHOULDERS

BACKGROUND OF THE INVENTION

1. Field of the Invention

The present invention relates to a printer and, more particularly, to a printer in which the printed image data exactly covers an entire sheet of paper without skewing or producing margins in the upper or lower portions of the paper sheet.

2. Description of the Related Art

There are many types of printers for printing image data on a sheet of paper. For example, there is known a thermal transfer printer comprising a thermal transfer head for generating heat responsive to image data, and an ink film disposed under the thermal transfer head, wherein the image data is printed on the paper sheet disposed under the thermal transfer head by the head and ink film. Especially, in a color thermal transfer printer, three resolved images of yellow, magenta and cyan are sequentially printed on the paper sheet to accomplish full coloring of the completed picture. In such a thermal transfer printer, the paper sheet is printed by sublimation of ink on the ink film which is heated by the thermal transfer head.

The printed matter resulting from such a thermal transfer printer is extremely clear. Therefore, the thermal transfer printer can be used for various applications. For example, after inputting image data into a computer via an image input device such as a scanner, a newly contrived picture can be created by revising and/or combining the input data according to a computer program and then may be outputted. Also, imaginary scenes and objects created with computer graphics, or the images of an electron microscope may be outputted using the thermal transfer printer. As this type of thermal transfer printer now tends to be used in lieu of photography in many fields, the printer should have the same or similar quality and form as a photograph.

FIG. 1A and FIG. 1B illustrate printing states on a paper sheet by a conventional printer. As shown in FIG. 1A, a picture 1 is printed on the paper sheet causing margins 2 in the upper and lower portions of the paper sheet. Also, the picture 1 may be printed askew on the paper sheet, as shown in FIG. 1B.

The causes of these problems will be described hereinafter taking a conventional platen-type printer as an example.

FIG. 2 and FIG. 3 show a perspective view and a side view for illustrating a printing operation by a conventional platen-type printer, respectively. As can be seen, a supplied paper sheet 7 is brought into contact with a drum 8 by a guide roller 5 disposed on the periphery of drum 8. The paper sheet 7 is transported, passing under a printing head 6 disposed above the drum 8, according to the rotation of the drum 8 and until the leading edge of the sheet reaches a guide roller 13. Then, image data is printed on the paper sheet 7 with an ink film 4 and the paper sheet 7 being pressed against the drum 8. Accordingly, when the paper sheet 7 is supplied askew between the drum 8 and the guide roller 5, it is inevitable for the paper sheet 7 to be printed in a skewed state. Further, a margin extending by a distance D from an initial printing position 10 to the guide roller 13 is created in the leading edge portion of the paper sheet 7.

In addition, to prevent the paper sheet 7 from sliding in its proceeding direction and coming off the drum 8, a plurality of guide rollers 5, 13 and 14 are provided around the drum 8 as shown in FIG. 2 and FIG. 3, which increases the manufacturing cost of the printer.

The above-described margins in printed paper sheets, or the skewed printing thereon, causes a low quality appearance in the printed paper sheets, thereby resulting in wasted paper.

SUMMARY OF THE INVENTION

An object of the present invention is to provide a printer which is able to print image data on the entire paper sheet without causing any margins in the upper and lower portions of the paper sheet and without any skewing of the image data with respect to the paper sheet.

Another object of the present invention is to provide a printer which is able to effectively cause a paper sheet to be in contact with a drum, while having a simple structure.

To accomplish the above objects, a printer according to the present invention comprises a drum rotated to transport a paper sheet together with and at the periphery of the drum, at least one guide roller disposed at the periphery of the drum and rotated while in contact with the drum to guide the paper sheet against the drum, and printing means for printing image data on the paper sheet, wherein a shoulder is formed at each side of the drum for guiding the sides of the paper sheet so that the paper sheet is transported between the shoulders.

BRIEF DESCRIPTION OF THE DRAWINGS

The above objects and advantages of the present invention will become more apparent by describing in detail a preferred embodiment thereof with reference to the accompanying drawings in which.

DETAILED DESCRIPTION OF THE INVENTION

A preferred embodiment of the present invention will be described hereinbelow with reference to the accompanying drawings.

Figure 1A:
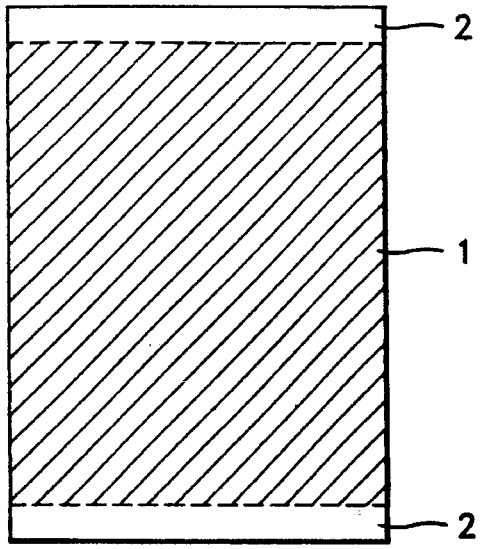
FIG. 1A (PRIOR ART)
FIG. 1A and FIG. 1B illustrate printing states on a paper sheet by a conventional printer.
Figure 1B:
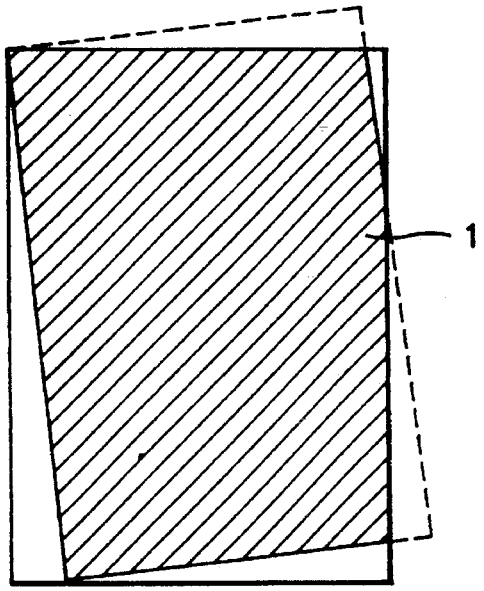
FIG. 1B (PRIOR ART)
Figure 2:
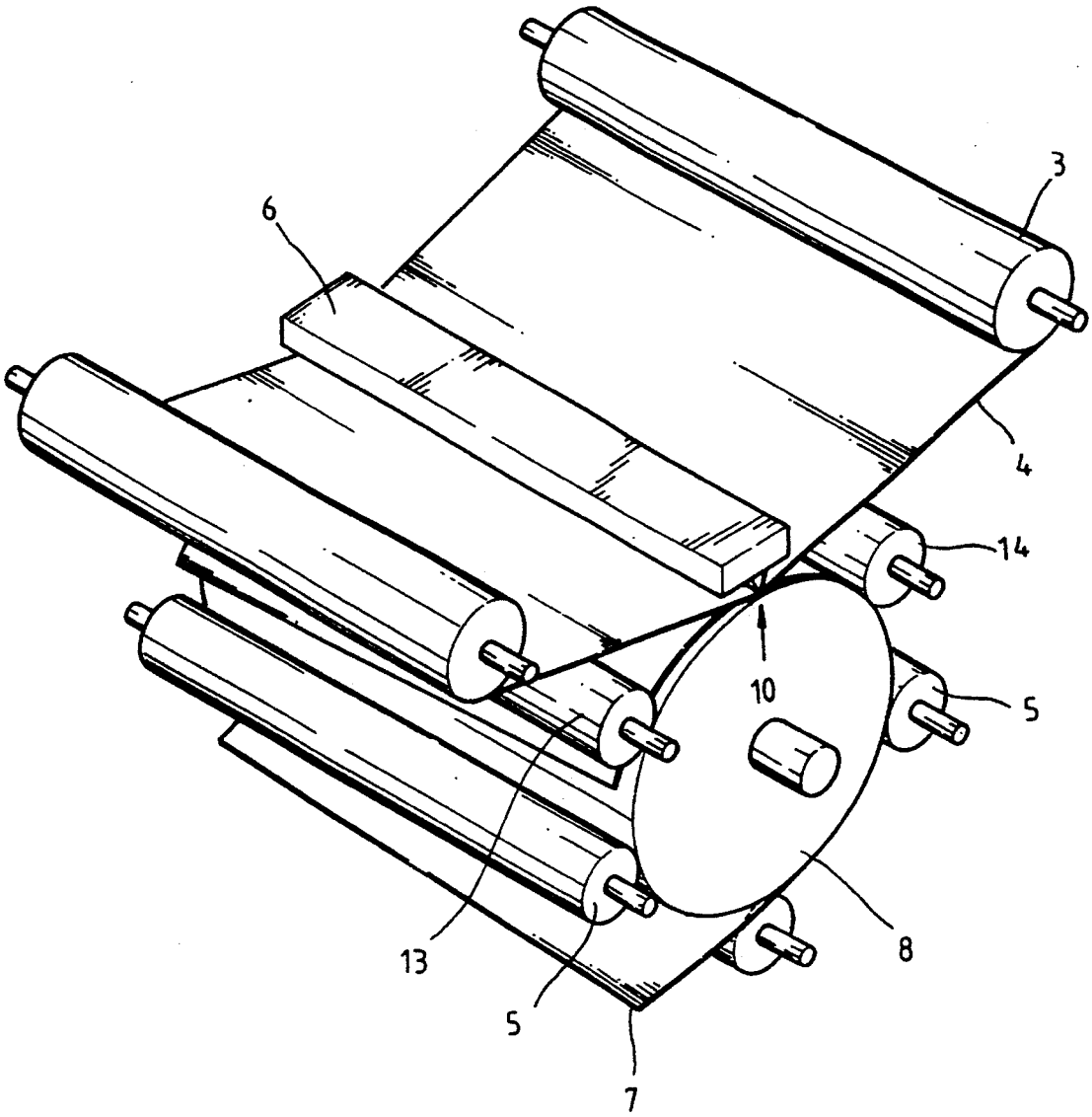
FIG.2 (PRIOR ART)
FIG. 2 shows a perspective view for illustrating a printing operation of a conventional platen-type printer.
Figure 3:
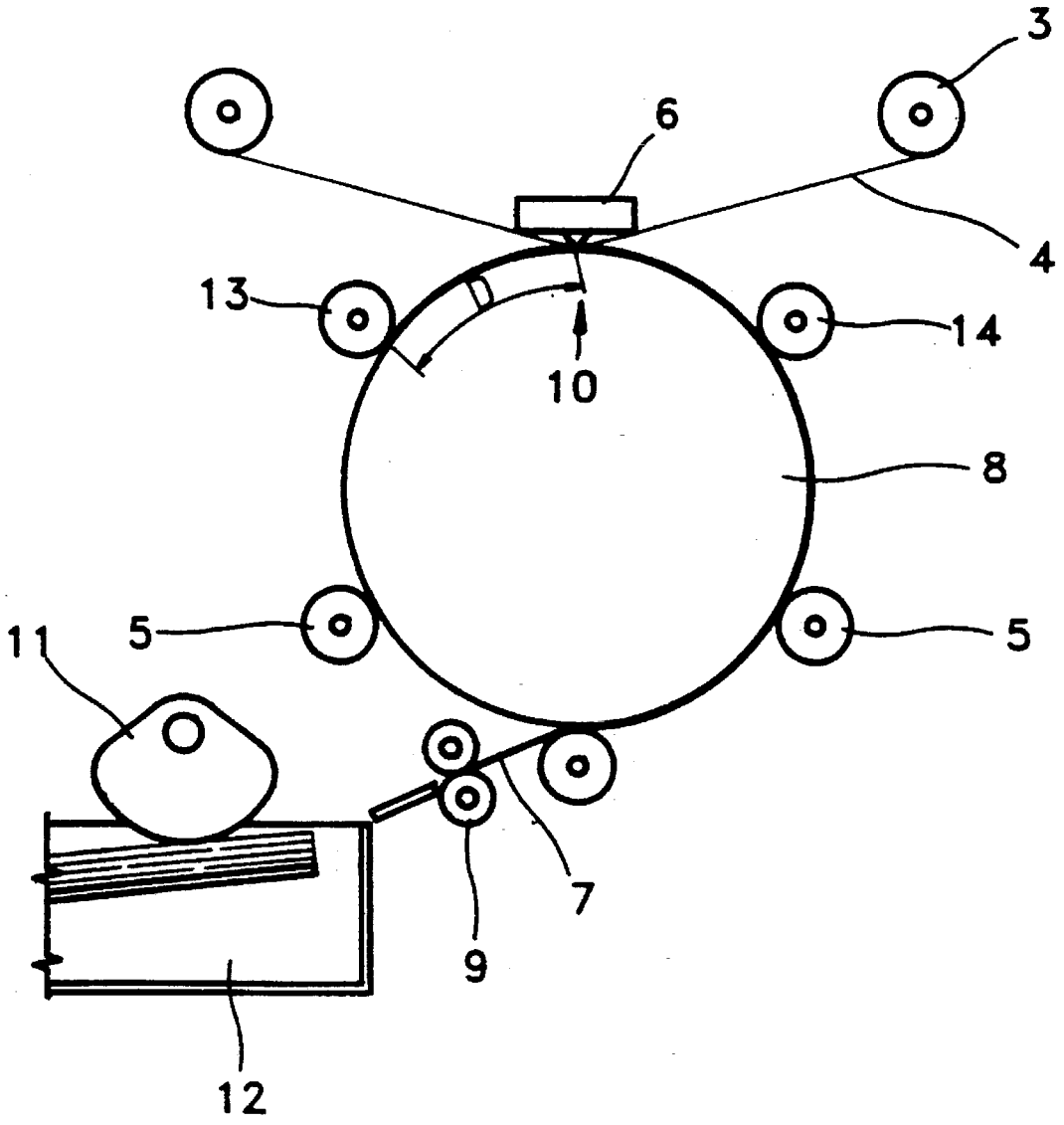
FIG.3 (PRIOR ART)
FIG. 3 shows a side view for illustrating a printing operation of the conventional platen-type printer.
Figure 4:
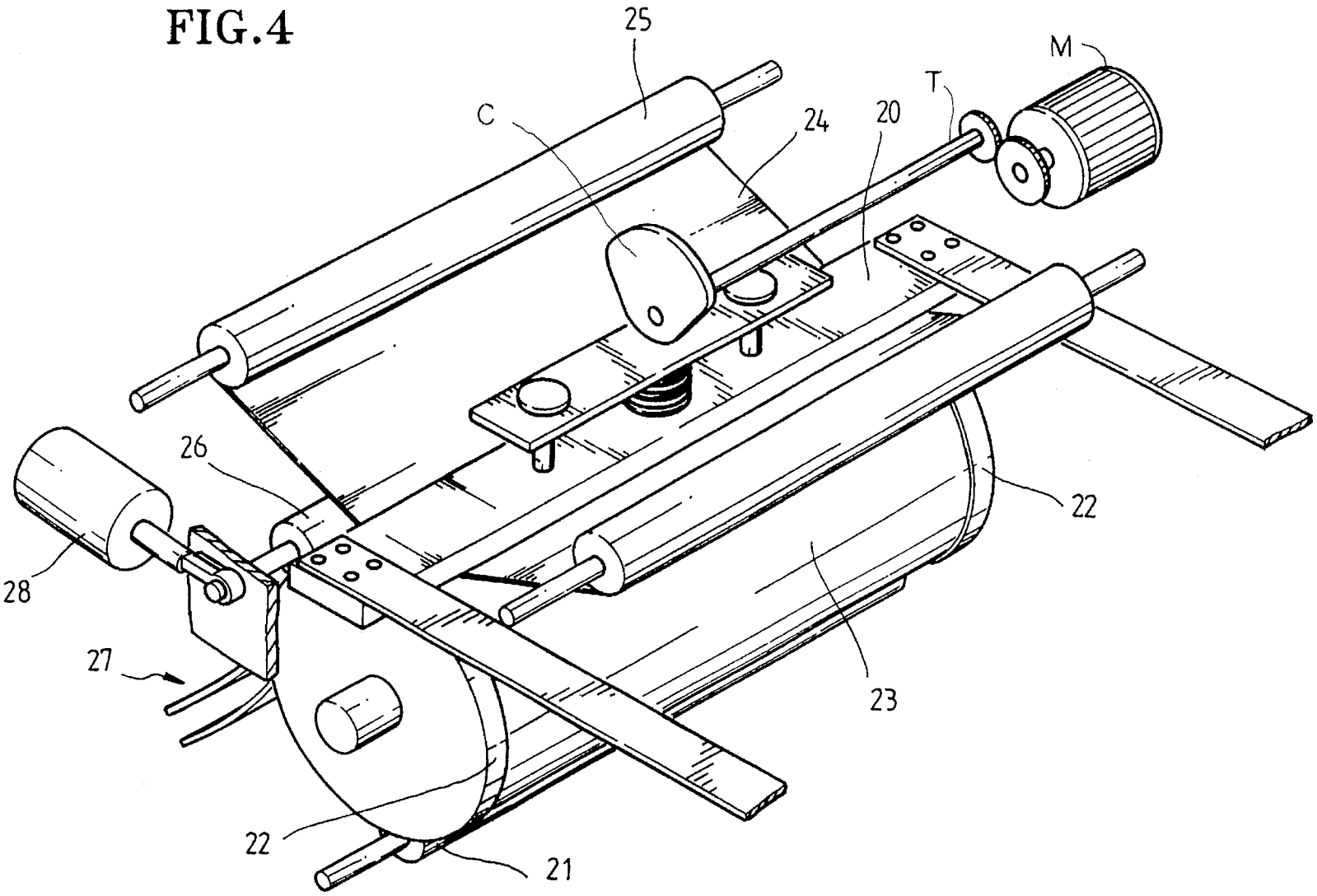
FIG. 4 shows a perspective view of a platen-type printer according to the present invention.
Figure 5:
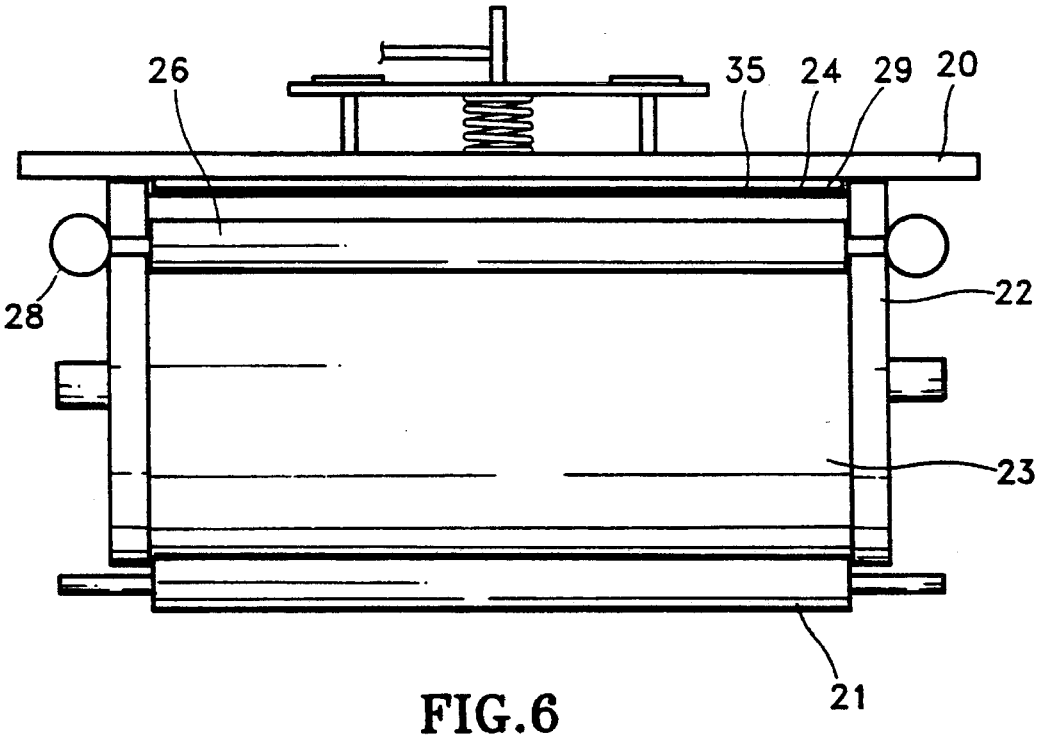
FIG. 5 shows a front view of the platen-type printer according to the present invention.
Figure 6:
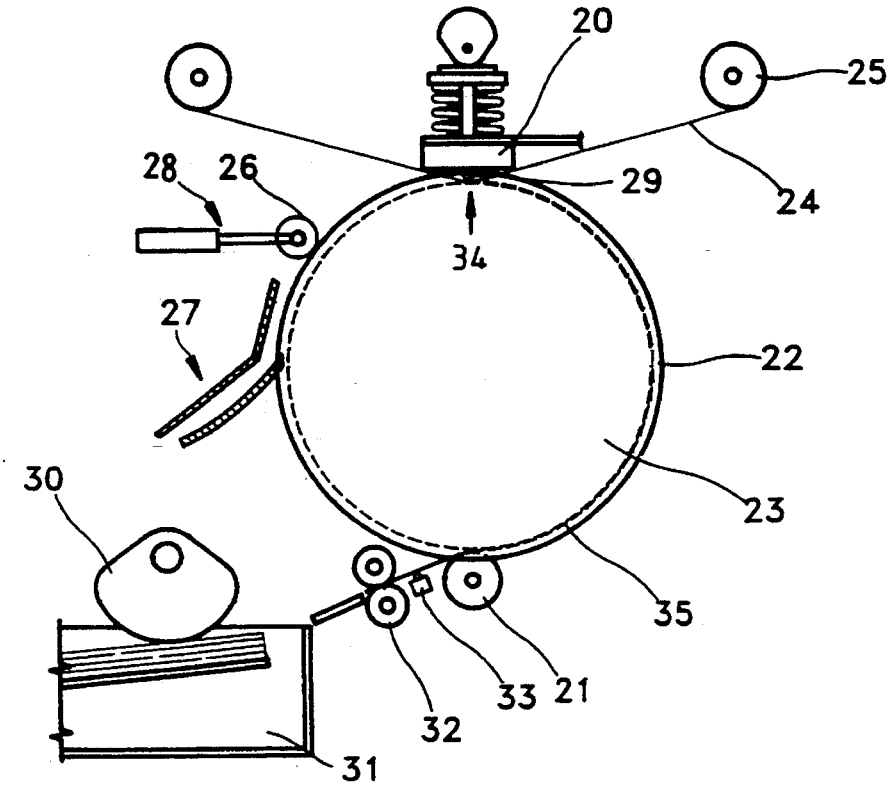
FIG. 6 and FIG. 7 are side views for illustrating a printing operation of the platen-type printer according to the present invention.

FIG. 4 and FIG. 5 show a perspective view and a front view of a platen-type printer according to the present invention, respectively. As can be seen, a thermal element 29 is provided at a lower portion of a printing head 20 for transferring image data onto a sheet of paper 35. The printing head 20 is part of a printing device which includes a motor M, a transmission T and a cam C for raising and lowering the printing head 20. Below the thermal element, an ink film 24 which contains three colors, i.e., yellow, magenta and cyan, in sequence is rolled up between ink film reels 25 provided at both sides of printing head 20, as shown in FIG. 6. A drum 23 is installed below ink film 24, for transporting the paper sheet 35 together with and at the periphery of the drum according to the rotation of the drum. A shoulder 22 made of a resilient material is formed at each side or end of the drum 23, for preventing the paper sheet 35 from becoming skewed with respect to the drum 23. A distance between the shoulders 22 is normally less than or equal to the width of the paper sheet but is extensible. At a paper supplying portion of the printer, a guide roller 21 is provided on the periphery of drum 23 for guiding the paper sheet 35 so that the sheet is inserted between shoulders 22 while in contact with the drum 23. The length of the guide roller 21 is less than or equal to the distance between the shoulders 22. At the front of guide roller 21, a pair of supplying rollers 32 are installed for pushing the paper sheet between drum 23 and guide roller 21. A cassette 31 for storing paper and provided with a cam 30 for supplying paper sheets therefrom is installed at the front of the supplying rollers 32. A sensor 33 is provided for detecting the leading and trailing edges of the paper sheet, between the supplying rollers 32 and the guide roller 21.

At a paper discharging portion of the printer, a discharging roller 26, for discharging the paper sheet transported between the shoulders 22 from the drum 23 and whose length is greater than the width of the paper sheet, is installed at the periphery of the drum 23. A solenoid 28 is coupled to each of the ends of the shaft of the discharging roller 26 for pushing into or drawing out the discharging roller 26 between the shoulders 22 of drum 23. Because the shoulders 22 are made of a resilient material, this allows the shoulders 22 to deform slightly upon insertion of the discharging roller 26 therebetween by the solenoid 28. A discharging plate 27 is installed below the discharging roller 26.

Figure 7:
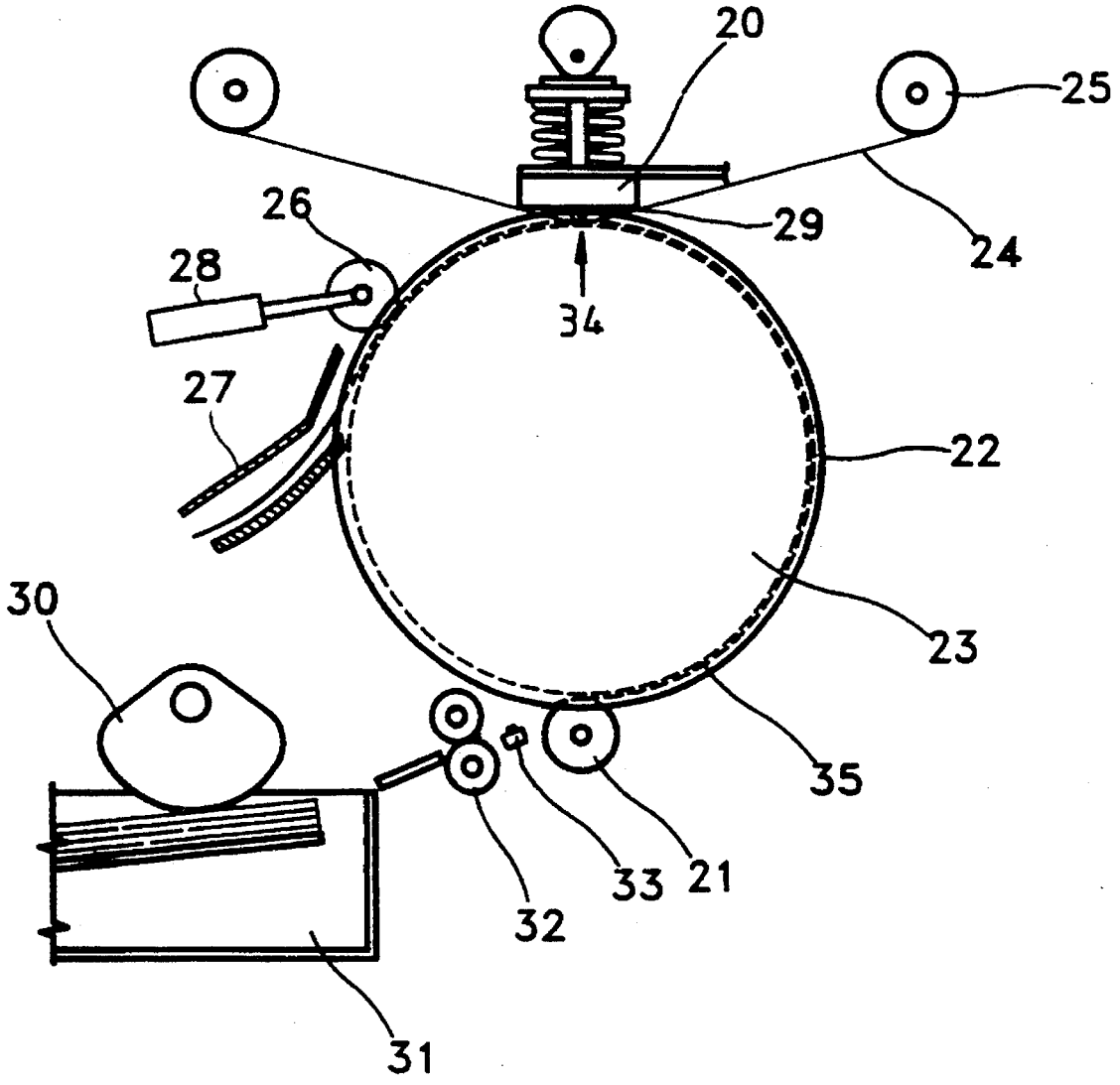

The operation of the platen-type printer according to the present invention will be described hereinbelow referring to FIGS. 6 and 7.

As shown in FIG. 6, a paper sheet 35 in cassette 31 is supplied to the supplying rollers 32 by the cam 30 and is transported between the drum 23 and the guide roller 21 by the supplying rollers 32. At this time, the sensor 33 provided between the supplying rollers 32 and the guide roller 21 detects the leading and trailing edges of the paper sheet. The paper sheet 35 is brought into contact with drum 23 between the shoulders 22 of the drum by the guide roller 21. Then, according to rotation of the drum 23, the paper sheet is transported to an initial printing position 34. As the shoulders 22 guide both ends of the paper sheet, the sheet stays in contact with drum 23 without becoming skewed from the drum 23. When the leading edge of the paper sheet reaches the initial printing position 34, the printing head 20 presses the ink film 24 and the paper sheet so as to print a first color on the sheet according to a signal from the sensor 33. When printing of the trailing edge of the sheet is completed, the printing head 20 is raised according to the signal from the sensor 33. Then, the drum 23 rotates until the leading end of the paper sheet reaches the initial printing position again. The next two colors are printed on the paper sheet by the same method as the first color. As shown in FIG. 7, after the printing of the last color is completed, when the paper sheet proceeds towards the discharging plate 27, the discharging roller 26 is inserted between the shoulders 22 of drum 23 by means of solenoid 28. Since the length of discharging roller 26 is slightly greater than the distance between shoulders 22, the distance between the shoulders 22 extends due to the slight deformation of the resilient shoulders 22 so that the paper sheet is released from the drum 23. At this time, the discharging roller 26 can be easily inserted between the shoulders 22 because the distance between the shoulders 22 is extensible as described above. Accordingly, the paper sheet discharges towards the discharging plate 27 by the rotation of the drum 23.

As described above, in the printer according to the present invention, it is possible to print image data on the entire paper sheet without causing any margins in the upper and lower portions of the paper sheet and without any skewing of the image data from the paper sheet, thereby preventing wasted paper. Also, the paper sheet can be brought into contact with the drum with a simple structure, thereby reducing the manufacturing cost of the printer.

It is contemplated that numerous modifications may be made to the printer of the present invention without departing from the spirit and scope of the invention as defined in the following claims.

What is claimed is:

1. A printer comprising: a rotating drum for transporting a paper sheet, said drum including a periphery and opposite ends; at least one guide roller disposed at the periphery of said drum and rotated while in contact with said drum for guiding the paper sheet against said drum; and a printing device for printing image data on the paper sheet, the paper sheet including a pair of side edges, wherein an annular shoulder is formed at each of said ends of said drum for guiding the side edges of the paper sheet, each of said annular shoulders projecting above the periphery of the drum to thereby define annular inner side edges, so that the paper sheet is transported between said annular inner side edges of said annular shoulders without becoming skewed with respect to said drum.

2. The printer as claimed in claim 1, wherein said at least one guide roller is installed at a paper supplying portion of said drum and said at least one guide roller has a length which is less than or equal to a distance between said annular shoulders.

3. The printer as claimed in claim 1, further comprising a discharging roller which is installed at a paper discharging portion of said drum and which has a length which is greater than a distance between said annular shoulders, and wherein said annular shoulders are formed of a resilient material such that the distance between said annular shoulders is extensible to permit said discharging roller to be inserted between said annular shoulders by means of a solenoid.

4. A printer comprising: a rotating drum for transporting a paper sheet, said drum including a periphery and opposite ends; at least one guide roller disposed at the periphery of said drum and rotated while in contact with said drum for guiding the paper sheet against said drum; and a printing device for printing image data on the paper sheet, the paper sheet including a pair of side edges, wherein an annular shoulder is formed at each of said ends of said drum for guiding the side edges of the paper sheet so that the paper sheet is transported between said annular shoulders without becoming skewed with respect to said drum, and further wherein said at least one guide roller is installed at a paper supplying portion of said drum and said at least one guide roller has a length which is less than or equal to a distance between said annular shoulders.

5. A printer comprising: a rotating drum for transporting a paper sheet, said drum including a periphery and opposite ends; at least one guide roller disposed at the periphery of said drum and rotated while in contact with said drum for guiding the paper sheet against said drum; and a printing device for printing image data on the paper sheet, the paper sheet including a pair of side edges, wherein a shoulder is formed at each of said ends of said drum for guiding the side edges of the paper sheet so that the paper sheet is transported between said shoulders, and further comprising a discharging roller which is installed at a paper discharging portion of said drum and which has a length which is greater than a distance between said shoulders, and wherein said shoulders are formed of a resilient material such that the distance between said shoulders is extensible to permit said discharging roller to be inserted between said shoulders by means of a solenoid.

* * * * *